US006217404B1

(12) United States Patent
Liao

(10) Patent No.: US 6,217,404 B1
(45) Date of Patent: Apr. 17, 2001

(54) TOY AIRPLANE

(76) Inventor: Yun Hwan Liao, No. 16, Lane 129, Da-Lin Rd., Chu-Tung Town, Hsinchu Hsien (TW)

( * ) Notice: Subject to any disclaimer, the term of this patent is extended or adjusted under 35 U.S.C. 154(b) by 0 days.

(21) Appl. No.: 09/596,075

(22) Filed: Jun. 16, 2000

(51) Int. Cl.[7] ..... A63H 27/16
(52) U.S. Cl. ..... 446/67; 446/61; 446/68
(58) Field of Search ..... 446/34, 61, 67, 446/68, 88, 93

(56) References Cited

U.S. PATENT DOCUMENTS

| | | | | |
|---|---|---|---|---|
| 2,168,653 | * | 8/1939 | Meagher, Jr. | 446/67 |
| 2,343,710 | * | 3/1944 | Russell | 446/67 |
| 2,351,504 | * | 6/1944 | Guillow | 446/67 |
| 4,103,454 | * | 8/1978 | Stone | 46/79 |
| 4,203,250 | * | 5/1980 | Garofalo | 46/79 |
| 5,482,489 | * | 1/1996 | Stone | 446/67 |
| 5,741,168 | * | 4/1998 | Chen | 446/66 |
| 5,853,312 | * | 12/1998 | Li | 446/61 |

* cited by examiner

*Primary Examiner*—Jacob K. Ackun
*Assistant Examiner*—Faye Francis
(74) *Attorney, Agent, or Firm*—Rosenberg, Klein & Lee

(57) ABSTRACT

The present invention proposes a toy airplane, which can turn a round and fly back to the original position where it has been launched by hand. The toy airplane comprises a foldable fuselage, a wing, a tail, a central fixing plate, a tail fin, a balance weight block, and a plurality of adhesive sheets. A pair of wing slots and a pair of tail slots are respectively disposed at the middle section and rear section of the foldable fuselage. The wing slot forms a specific curve, and the tail slot is matched with the wing slot to tilt a proper angle. The wing and the tail can exactly penetrate through the wing slots and the tail slots, respectively. Notches are respectively disposed at the front edges and rear edges of the central lines of the wing and the tail. The central fixing plate having a balance weight groove and a first retaining groove is installed in the foldable fuselage and is fastened in the two notches of the wing via the first retaining groove. The balance weight groove is provided to install the balance weight block. The tail fin is installed in the rear section of the foldable fuselage and is fastened in the two notches of the tail via a second retaining groove of the tail fin. A plurality of adhesive sheets are pasted at unstuck positions at one side of the foldable fuselage to exactly fix each component installed in the foldable fuselage.

3 Claims, 5 Drawing Sheets

TOY AIRPLANE

FIELD OF THE INVENTION

The present invention relates to a toy airplane and, more particularly, to an assembled toy airplane, which can fly back to the original position where it has been launched by hand.

BACKGROUND OF THE INVENTION

During the growth of a child, toys are indispensable companions. In addition to providing a presentation way of emotions and feelings, toys also have training effects such as role playing, development of bodily functions, concordance of hands and eyes, and so on. Therefore, giving a good safety toy to a child can create much added value.

It is an easy game for almost every child to fold a paper airplane for play. However, the probability that the paper airplane can fly successfully is small. Even if the paper airplane can fly successfully, it is difficult to control its flying direction and path. On the other hand, although the flying direction and path of a remote-control airplane can be controlled, much space is needed so that it can not be played indoors. Moreover, a remote-control airplane is very expensive.

Accordingly, the present invention proposes a toy airplane, which has both the advantages of the above two toy airplanes and overcomes their drawbacks.

SUMMARY AND OBJECTS OF THE PRESENT INVENTION

The primary object of the present invention is to provide a toy airplane, which can turn a round and fly back to the original position where it has been launched by hand. Moreover, the present invention does not need large place for play so that it can be played indoors.

Another object of the present invention is to provide a toy airplane having the characteristics of low price, safety, and fun.

According to the present invention, a pair of wing slots and a pair of tail slots are respectively disposed at the middle section and rear section of a foldable fuselage. The wing slot forms a specific curve, and the tail slot is matched with the wing slot to tilt a proper angle. A wing and a tail can exactly penetrate through the wing slots and the tail slots, respectively. Notches are respectively disposed at the front edges and rear edges of the central lines of the wing and the tail. A central fixing plate having a balance weight groove and a first retaining groove is installed in the foldable fuselage and is fastened in the two notches of the wing via the first retaining groove so that the central line of the wing is fixed at the center of the foldable fuselage. The balance weight groove is provided to install a balance weight block. A tail fin is installed in the rear section of the foldable fuselage and is fastened in the two notches of the tail via a second retaining groove of the tail fin so that the central line of the tail is fixed at the center of the foldable fuselage. A plurality of adhesive sheets are pasted at unstuck positions at one side of the foldable fuselage to exactly fix the central fixing plate, the tail, and other components installed in the foldable fuselage.

The various objects and advantages of the present invention will be more readily understood from the following detailed description when read in conjunction with the appended drawings, in which:

DETAILED DESCRIPTION OF PREFERRED EMBODIMENT

The present invention is characterized in that the curve of a wing is matched with the tilting angle of a tail so that a toy airplane has a certain flying direction and path to fly back to the original position where it has been launched by hand.

Figure 1:
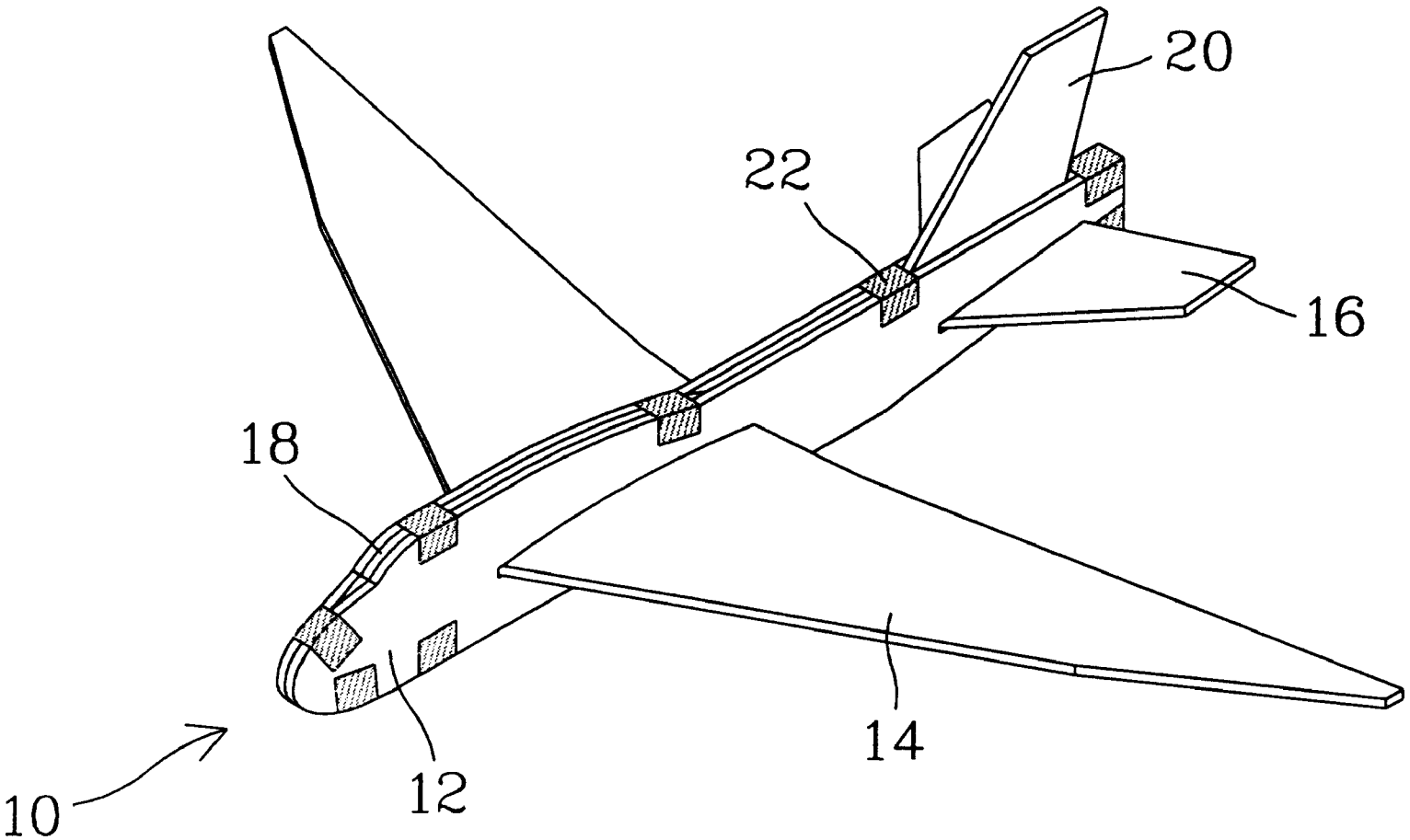
FIG. 1 is a perspective view of the present invention.

As shown in FIG. 1, a toy airplane 10 comprises a foldable fuselage 12, a wing 14, a tail 16, a central fixing plate 18, a tail fin 20, and a plurality of adhesive sheets 22. A balance weight block 24 (not shown) is also installed in the foldable fuselage 12 to provide a proper weight.

Figure 2:
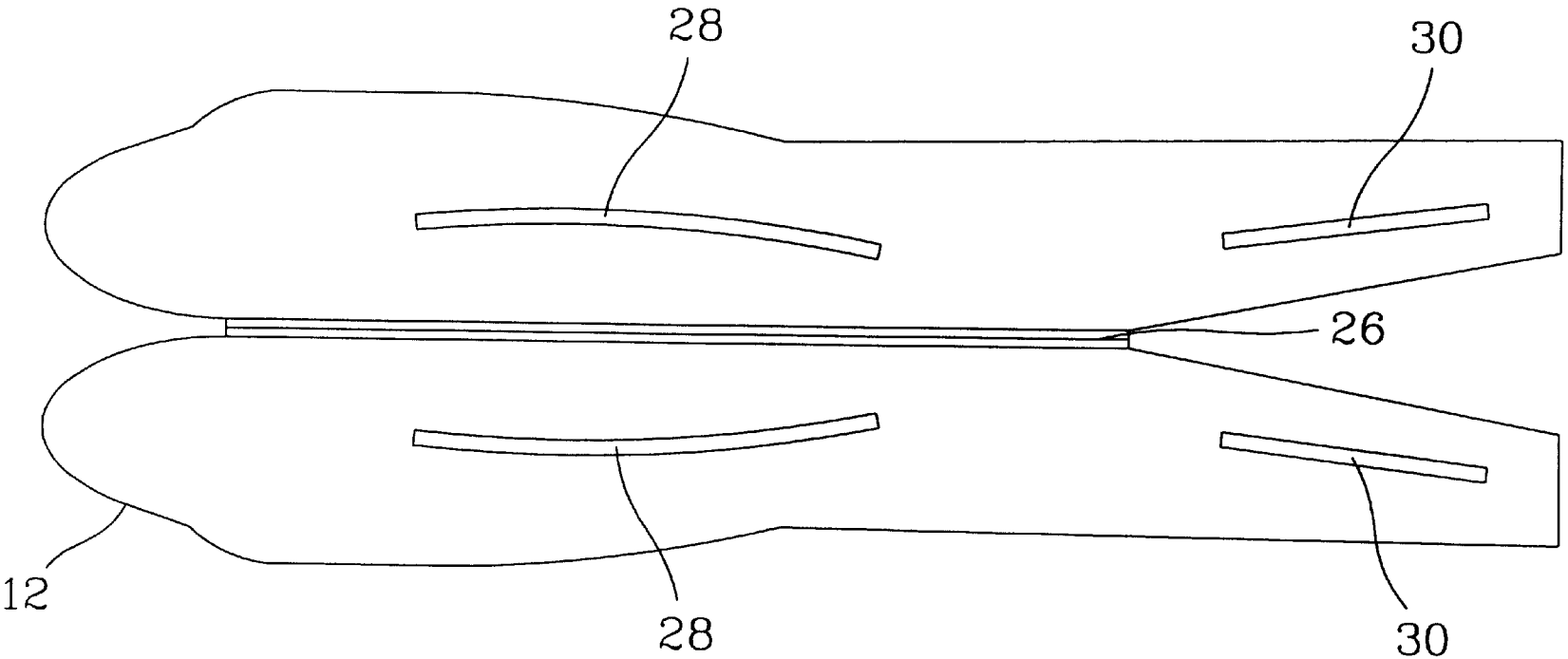
FIG. 2 is a view showing a wing of the present invention.

As shown in FIG. 2, the foldable fuselage is the main body of a toy airplane. A preset fold 26 is situated at the central line of the foldable fuselage 12 to facilitate its folding. A pair of symmetric wing slots 28 and a pair of symmetric tail slots 30 are respectively disposed at the middle section and the rear section of two sheets of the foldable fuselage 12. The wing slot 28 forms a specific curve. The width and length of the wing slots 28 are matched with a wing so that the wing can exactly penetrate through the wing slots 28 and forms the same curve. The tail slots 30 are provided for the penetration of a tail and are matched with the wing slots 28 to tilt a proper angle. The tilting angle is preferred to be 7°.

Figure 3:
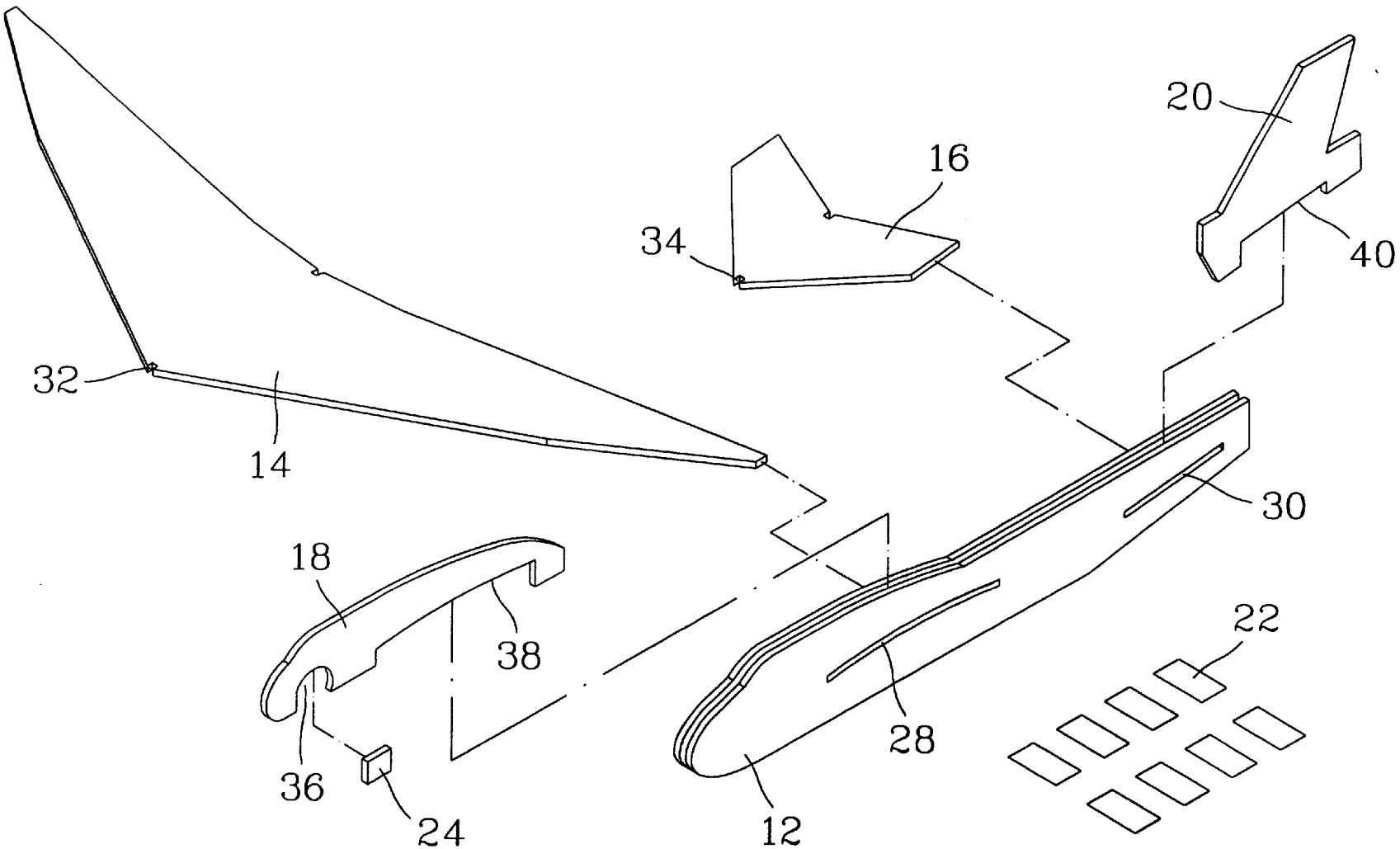
FIG. 3 is an exploded perspective view of the present invention.

As shown in FIG. 3, the wing 14 is a symmetric angular plate. The length of central line of the wing 14 is the same as that of the wing slot 28 so that the wing 14 can exactly penetrate through the wing slots 28. Notches 32 are respectively disposed at the front edge and the rear edge of the central line of the wing 14. The length of central line of the tail 16 is the same as that of the tail slot 30 so that the tail 16 can exactly penetrate through the tail slots 30. Notches 34 are respectively disposed at the front edge and the rear edge of the central line of the tail 16. After the foldable fuselage 12 is folded, the folded fuselage 12 forms a V shape when viewed from head to tail because of resiliency of material. This V shape will fix the wing 14 and the tail 16 on a plane perpendicular to the fuselage 12 so that the wing 14 and the tail 16 will not wag.

A balance weight groove 36 and a first retaining groove 38 are formed at one side of the central fixing plate 18. The central fixing plate 18 is installed in the front section of the foldable fuselage 12, that is, in the front section of the two sheets of the foldable fuselage 12 . The central fixing plate 18 is fastened in the two notches 32 of the wing 14 via the first retaining groove 38 so that the central line of the wing 14 can be fixed at the center of the foldable fuselage 12. The balance of the two ends of the wing 14 can thus be achieved. The balance weight groove 36 of the central fixing plate 18 is situated in the front nose of the foldable fuselage 12. A metal balance weight block 24 is placed in the balance weight groove 36. The weight of the balance weight block 24 can be varied according to the size of the airplane. The balance weight block 24 provides a proper weight required for the flight of the toy airplane.

Figure 4:
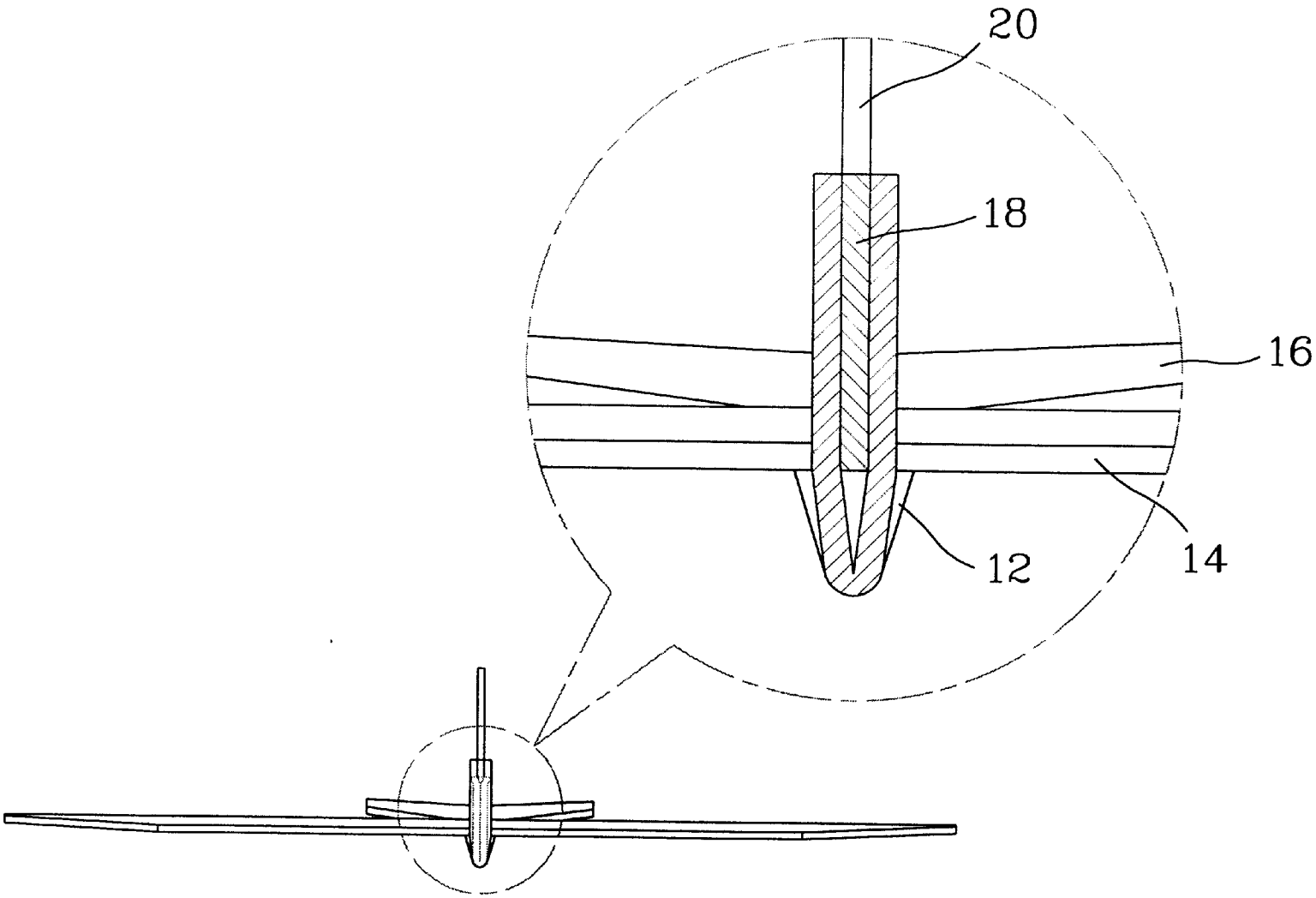
FIG. 4 is a front view of the present view.

A second retaining groove 40 is disposed at a proper position at one side of the tail fin 20. The tail fin 20 is installed in the rear section of the two sheets of the foldable fuselage 12. The tail fin 20 is fastened in the two notches of the tail 16 via the second retaining groove 40 so that the central line of the tail 16 can be fixed at the center of the foldable fuselage 12. A plurality of adhesive sheets 22 are pasted at unstuck positions at one side of the foldable fuselage 12 to exactly fix the two sheets of the foldable fuselage 12, the central fixing plate 18, the tail 14, and other components installed in the foldable fuselage 12. In other words, the adhesive sheets 22 are mainly used to paste the foldable fuselage 12 and are pasted at the head and the tail end of the foldable fuselage 12 to let the foldable fuselage 12 grip the central fixing plate 18 and the tail fin 20. Thereby the foldable fuselage 12 will be dovetailed to reduce the air friction during flight. As shown in FIG. 4, the middle section of the foldable fuselage 12 below the wing 14 maintains the original V shape to fix the wing 14, the tail 16 on a plane perpendicular to the foldable fuselage 12 so that they will not be easily displaced due to impact.

The adhesive sheet 22 can be a sticker or an adhesive tape.

Figure 5:
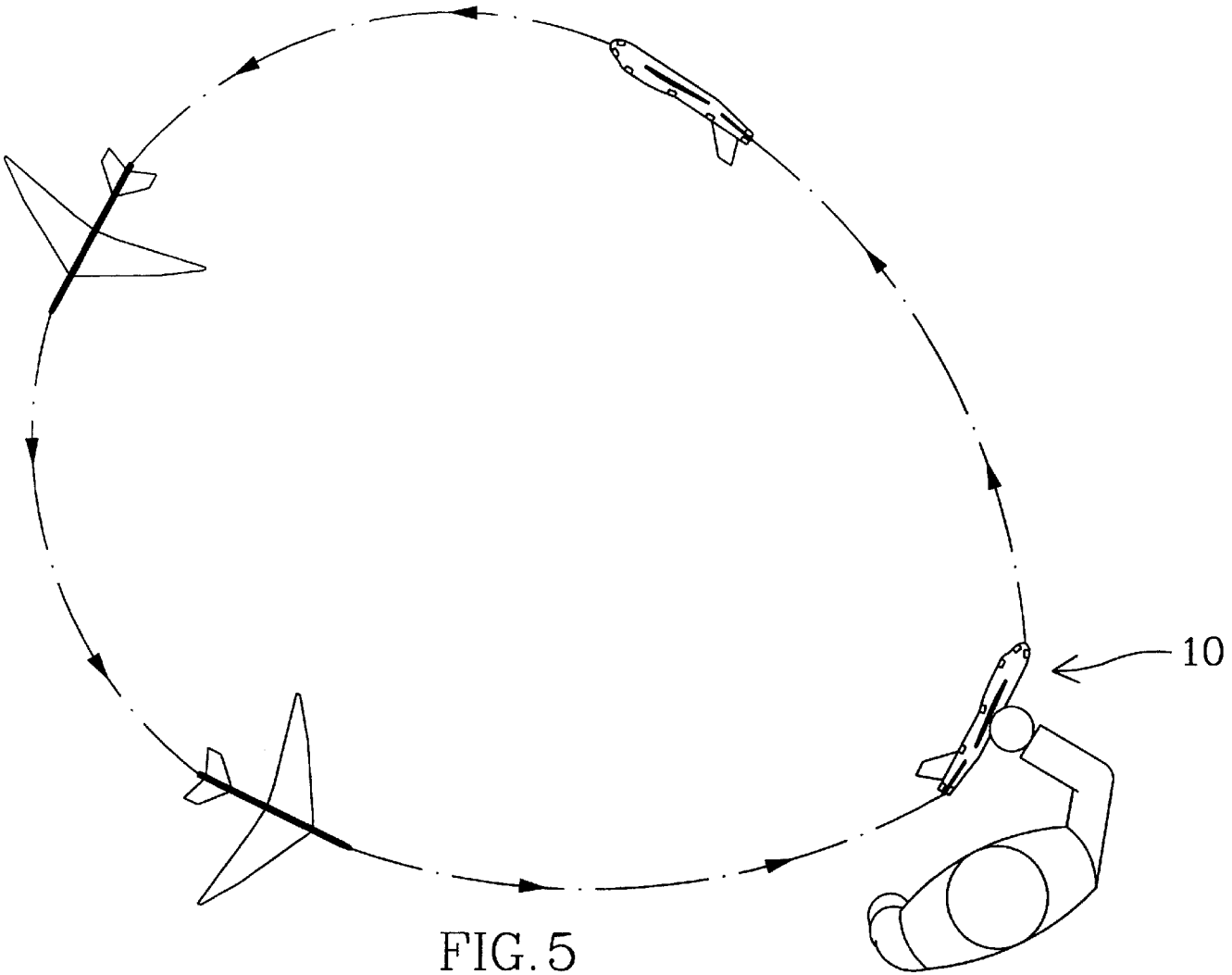
FIG. 5 is a diagram showing the flight of a toy airplane of the present invention.

Because the wing forms a specific curve along with the wing slots, the tail tilts a proper angle, and the balance weight block is used to provide a proper weight, the principles of hydrodynamics are fully exploited to keep the airplane flying on a plane. Moreover, because the steering wing lets the airplane revolve and the tail balances the airplane so that the airplane will not flip, when we launch the toy airplane 10 by hand, the toy airplane 10 will turn a round and fly back to the original position where it has been launched, as shown in FIG. 5. The flying direction and path of the toy airplane 10 can thus be controlled. More fun and teaching effect can be achieved to draw the attention of children. Moreover, large space is not needed so that the toy airplane of the present invention can be played indoors.

Additionally, the present invention is made of pearled sheets so that the characteristics of low price and safety can also be achieved.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A toy airplane comprising:

a foldable fuselage with a fold at the central line thereof, a pair of wing slots and a pair of tail slots being respectively disposed at the middle section and rear section of said foldable fuselage, said wing slots forming a specific curve, said tail slots matching with said wing slots to tilt a predetermined angle;

a wing being a symmetric angular plate, said wing exactly penetrating through said wing slots, notches being respectively disposed at the front edge and rear edge of the central line of said wing;

a tail exactly penetrating through said tail slots, notches being respectively disposed at the front edge and rear edge of the central line of said tail;

a central fixing plate with a balance weight groove and a first retaining groove formed on one side thereof, said central fixing plate being installed in the front section of said foldable fuselage and being fastened in said two notches of said wing via said first retaining groove so that the central line of said wing is fixed at the center of said foldable fuselage;

a tail fin with a second retaining groove formed at a predetermined position at one side thereof, said tail fin being installed in the rear section of said foldable fuselage and being fastened in said two notches of said tail via said second retaining groove so that the central line of said tail is fixed at the center of said foldable fuselage;

a balance weight block being fixedly installed in the front section of said foldable fuselage via said balance weight groove of said central fixing plate; and a plurality of adhesive sheets being pasted at unstuck positions at one side of said foldable fuselage to exactly fix each components installed in said foldable fuselage.

2. The toy airplane of claim 1, wherein the tilting angle of said tail slots is preferred to be 7°.

3. The toy airplane of claim 1, wherein said adhesive sheet is a sticker or an adhesive tape.

* * * * *